US005768735A

United States Patent [19]

Wiese et al.

[11] Patent Number: 5,768,735

[45] Date of Patent: Jun. 23, 1998

[54] SWITCH MECHANISM WITH MECHANICAL LOCK OUT

[75] Inventors: Martin Wiese, South Bend; Thomas R. Nyborg, Mishawaka, both of Ind.

[73] Assignee: Whtie Consolidated Industries, Inc., Cleveland, Ohio

[21] Appl. No.: 668,298

[22] Filed: Jun. 25, 1996

[51] Int. Cl.[6] ..... A47L 11/62

[52] U.S. Cl. ..... 15/49.1; 15/98; 15/DIG. 10; 200/43.17; 451/350

[58] Field of Search ..... 15/49.1, 98, 50.1, 15/DIG. 10; 200/43.16, 43.17; 451/350, 353

[56] References Cited

U.S. PATENT DOCUMENTS

| | | | |
|---|---|---|---|
| 1,930,117 | 10/1933 | Yutzler | 15/DIG. 10 |
| 2,041,748 | 5/1936 | Engberg et al. . | |
| 3,236,985 | 2/1966 | Ernolf . | |
| 3,604,878 | 9/1971 | Amis, Jr. . | |
| 3,889,774 | 6/1975 | Schwenk . | |
| 4,174,473 | 11/1979 | Brenneman . | |
| 4,435,870 | 3/1984 | Tucker et al. . | |
| 4,542,551 | 9/1985 | Phillips . | |
| 4,618,746 | 10/1986 | Schwob et al. . | |
| 4,900,881 | 2/1990 | Fischer . | |
| 5,261,140 | 11/1993 | Szymanski . | |
| 5,369,236 | 11/1994 | Nickels, Jr. . | |
| 5,435,035 | 7/1995 | Fujimoto et al. | 15/49.1 |

*Primary Examiner*—Terrence Till
*Attorney, Agent, or Firm*—Pearne, Gordon, McCoy & Granger LLP

[57] ABSTRACT

A rotary floor machine having a base, a pole handle, a pole structure, a handlebar, a trigger bar, and a lock-out device. The pole handle is pivotally secured to the base and is movable between a vertical position and a rear angular position. The pole structure is secured to the pole handle. The handlebar is secured to the pole structure so as to be substantially perpendicular to the pole handle. The trigger bar controls the starting and stopping of the rotary floor machine and is mounted to the handlebar so as to be movable between proximate and distal positions relative to the handlebar. The trigger bar starts the rotary floor machine when in the proximate position and stops the rotary floor machine when in the distal position. The lock-out device has an element that is movable between a blocking position and an un-blocking position in response to movement of the pole handle between the vertical position and the rear angular position. When the element is in the blocking position, the element blocks the movement of the trigger bar from the distal position to the proximate position. When the element is in the un-blocking position, the element does not block the movement of the trigger bar to the proximate position.

22 Claims, 2 Drawing Sheets

SWITCH MECHANISM WITH MECHANICAL LOCK OUT

BACKGROUND OF THE INVENTION

1. Field of the Invention

This invention relates to rotary floor machines in general and, more particularly, to a lock out device for controlling the start-up of a rotary floor machine.

2. Description of the Related Art

A rotary floor machine is used to apply a treatment to a floor such as scrubbing, sanding or buffing. Some rotary floor machines can only apply one type of treatment, while other rotary floor machines can apply a variety of treatments. A rotary floor machine is usually guided by an operator walking behind the rotary floor machine. Typically, a rotary floor machine includes a treatment element, a motor, a base, a pole handle, a handlebar and a trigger mechanism.

The form of the treatment element depends on the type of treatment being applied. For example, a treatment element for scrubbing will typically include a circular disk having a plurality of bristles projecting downward therefrom, while a treatment element for sanding will typically include a flexible circular pad fitted with a piece of sandpaper. Some rotary floor machines have multiple treatment elements that operate simultaneously. This is more common with rotary floor machines that are used exclusively for scrubbing than it is for other types of rotary floor machines.

The base supports the motor above the treatment element. The motor has a shaft that projects through an opening in the bottom of the base. The treatment element is secured to the shaft so as to rotate therewith. The treatment element, however, is usually releasably secured to the shaft so as to permit the treatment element to be replaced when it wears out and to permit the installation of different types of treatment elements in the rotary floor machine.

The pole handle is pivotally secured to the base so as to be movable between a plurality of positions. The handle bar is transversely mounted to the top of the pole handle and enables the operator to interface with the rotary floor machine. The trigger mechanism is usually located proximate to the handlebar and is operable to start and stop the motor. Typically, the trigger mechanism is comprised of a trigger bar located below the handlebar. The trigger bar is parallel with the handlebar and is vertically movable between an "on" position located towards the handlebar and an "off" position located away from the handlebar. A spring is provided to normally urge the trigger bar away from the handlebar and to the "off" position.

The motor and the base are positioned directly over the treatment element in order to provide a downward force on the treatment element. The downward force increases the effectiveness of the treatment element. However, the downward force also tends to urge the entire rotary floor machine to rotate and "walk away from the operator". As can be appreciated, the farther an operator holds the handlebar away from the rotating shaft of the motor, the easier it is for the operator to prevent the rotary floor machine from "walking away". Accordingly, the operator must exert the greatest amount of effort to control the rotary floor machine when the pole handle is held in the vertical position. In fact, the operator must exert so much effort to control the rotary floor machine when the pole handle is in the vertical position that the operator will often lose grip of the handle bar. This is especially true if the rotary floor machine is inadvertently turned on when the operator is not firmly grasping the handlebar. If the operator loses grip of the handlebar, the pole handle can whip around and hit the operator.

Several lock out devices have been developed to prevent a rotary floor machine from "walking away". Most of these lock out devices involve an additional pushbutton or lever that has to be actuated before the trigger mechanism can be moved to an "on" position. Examples of such lock out devices are shown in U.S. Pat. No. 5,261,140 to Szymanski, U.S. Pat. No. 4,542,551 to Phillips, and U.S. Pat. No. 4,174,473 to Brenneman, all of which are incorporated herein by reference. Such lock out devices prevent an inadvertent start-up of the rotary floor machine, but they do not prevent the rotary floor machine from being started-up when the pole handle is in a vertical position.

Several lock out devices have been developed that automatically turn off the rotary floor machine when the handle is in the vertical position. Examples of such lock out devices are shown in expired U.S. Pat. No. 2,041,748 to Engberg and expired U.S. Pat. No. 3,236,985 to Ernolf, both of which are incorporated herein by reference. These lock out devices, however, also operate as the trigger mechanism, i.e., they are the sole mechanism by which the rotary floor machine is turned on and off. Accordingly, the operator cannot move the pole handle to a rear angular position without the rotary floor machine turning on, which is not necessarily desirable.

As can be appreciated from the foregoing, there is a need in the art for a rotary floor machine having a lock-out device and a pivotally movable pole handle wherein the lock-out device prevents the rotary floor machine from being started-up when the pole handle is in a vertical position and wherein the lock-out device does not also function as a trigger mechanism. The present invention is directed to such a rotary floor machine.

SUMMARY OF THE INVENTION

It therefore would be desirable, and is an advantage of the present invention, to provide a rotary floor machine having a lock-out device and a pivotally movable pole handle wherein the lock-out device prevents the rotary floor machine from being started when the pole handle is in a vertical position and wherein the lock-out device does not also function as a trigger mechanism. In accordance with the present invention, a rotary floor machine is provided having a base, a pole handle, a pole structure, a handlebar, a trigger bar, and a lock-out device. The base has a front and a rear. The pole handle is pivotally secured to the base and is movable between first and second positions. The pole structure is secured to the pole handle. The handlebar is secured to the pole structure so as to be substantially perpendicular to the pole handle. The trigger bar controls the starting and stopping of the rotary floor machine and is mounted to the handlebar so as to be movable between proximate and distal positions relative to the handlebar. The trigger bar starts the rotary floor machine when in the proximate position and stops the rotary floor machine when in the distal position. The lock-out device has an element that is movable between a blocking position and an un-blocking position in response to movement of the pole handle between the first and second positions. When the element is in the blocking position, the element blocks the movement of the trigger bar from the distal position to the proximate position. When the element is in the non-blocking position, the element does not block the movement of the trigger bar from the distal position to the proximate position. The element is in the blocking position and thereby prevents the starting of the rotary floor machine when the pole handle is in the first position. The element is in the un-blocking position and thereby permits the starting of the rotary floor machine when the pole handle is in the second position.

Also in accordance with the present invention, a rotary floor machine is provided having an electric motor, a base, a treatment element, a pole handle, an enclosure, a handlebar, a trigger bar, control means, and a lock-out device. The electric motor has a shaft that rotates when the electric motor is provided with electric power. The electric motor is vertically mounted on the base, which has a front, a rear and an opening through which the shaft projects. The treatment element is for contacting the floor. The treatment element is located beneath the base and is secured to the shaft for rotation therewith. The pole handle is pivotally secured to the base and is movable between a first position and a second position. The enclosure is secured to the pole handle and has opposing sides. The handlebar passes through the enclosure and extends outward from the opposing sides. The trigger bar passes through the enclosure and extends outward from the opposing sides. The trigger bar is movable relative to the handlebar between proximate and distal positions and is biased toward the distal position. The controlling means controls the connection of electric power to the electric motor in response to movement of the trigger bar between the proximate and distal positions. The controlling means connects electric power to the electric motor when the trigger bar is in the proximate position and disconnects electric power to the electric motor when the trigger bar is in the distal position. The lock-out device has an element that is movable between a blocking position and an un-blocking position in response to movement of the pole handle between the first and second positions. When the element is in the blocking position, the element blocks the movement of the trigger bar from the distal position to the proximate position. When the element is in the un-blocking position, the element does not block the movement of the trigger bar from the distal position to the proximate position. The element is in the blocking position and thereby prevents the connection of electric power to the electric motor when the pole handle is in the first position. The element is in the un-blocking position and thereby permits the connection of electric power to the electric motor when the pole handle is in the second position.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
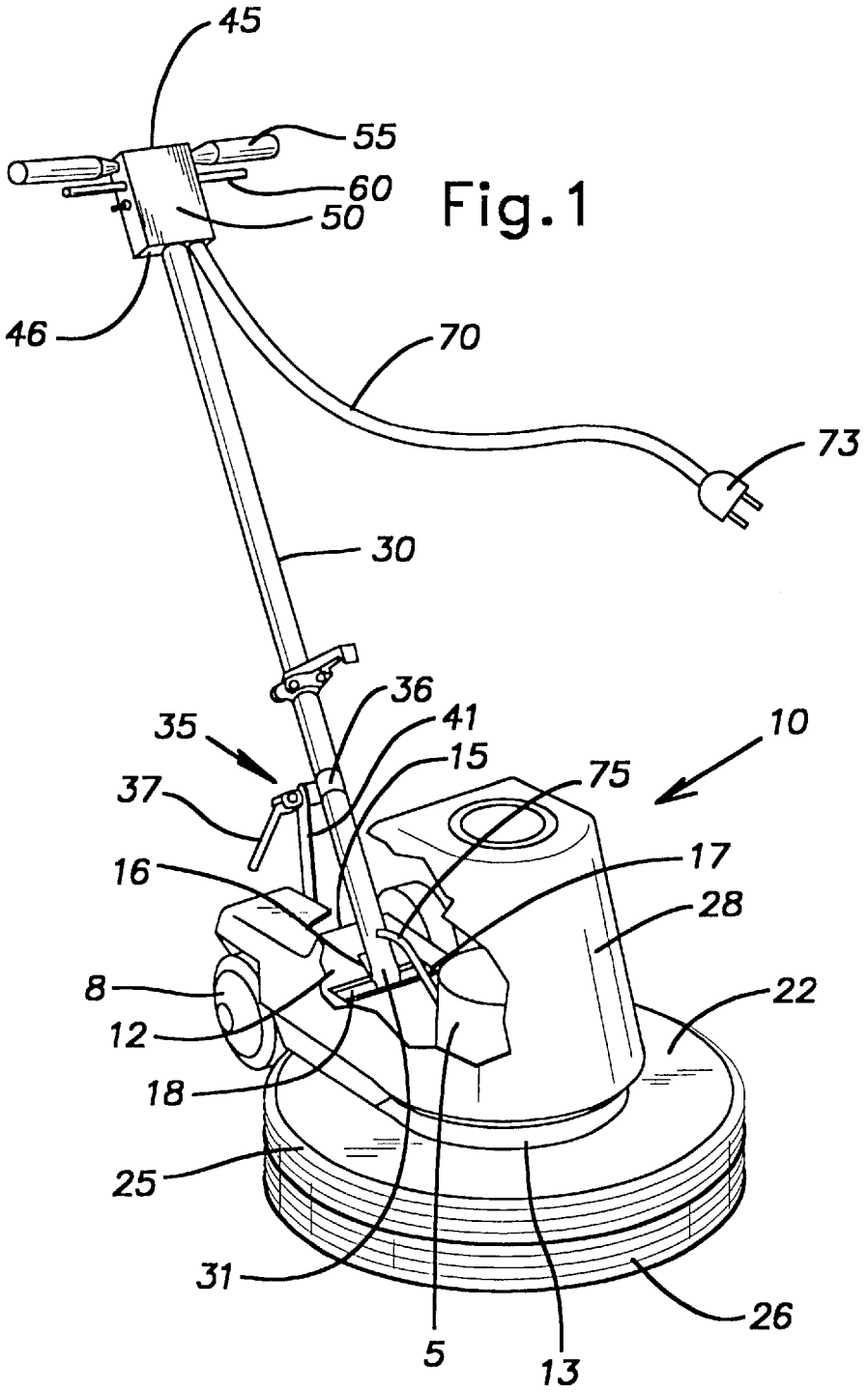
FIG. 1 shows a rotary floor machine with a portion of a motor housing cut-away.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a rotary floor machine 10 having a lock-out device 100 (shown in FIGS. 2, 3, 4) embodied in accordance with the present invention. The rotary floor machine 10 generally includes a base 12, a treatment element 26, a skirt 22, an electric motor 5, a motor housing 28, a pole handle 30, a switch box 45, a handlebar 55, and a trigger bar 60. The electric motor 5 is vertically mounted on top of the base 12 toward an anterior end 13 of the base 12. The electric motor 5 is a conventional 1 hp single capacitor motor that operates on standard 115 Volt, 60 Hz AC household power. The electric motor 5 has a shaft that rotates when the electric motor 5 is provided with electric power. The shaft projects through an opening (not shown) in the base 12 and is connected to a pad holder (not shown) located below the base 12.

The motor housing 28 is composed of plastic and has a raised front portion that slopes downward and rearward into a lower rear portion. A pair of sloping flanges project downward from the raised front portion and lower rear portion on opposing sides of the base 12. The raised front portion is substantially cylindrical and encloses the electric motor 5. The sloping flanges engage the opposing sides of the base 12 and help to secure the motor housing 28 to the base 12.

The treatment element 26 is releasably secured to the pad holder and rotates therewith when the electric motor 5 is provided with electric power. The treatment element 26 is approximately 20" in diameter and is comprised of a circular pad of rough, but resilient material. When the treatment element 26 is rotating and is placed into engagement with a floor covered with cleaning fluid, the treatment element 26 applies a scrubbing treatment to the floor. Since the treatment element 26 is releasably secured to the pad holder, the treatment element 26 can be removed and replaced with another treatment element for stripping, sanding, or polishing.

The skirt 22 is substantially cylindrical and has an upper end wall and a side wall. The skirt 22 is composed of chrome-plated steel and surrounds the pad holder so as to prevent cleaning fluid from splashing upward towards the operator. The upper end wall is secured to the base 12 such that a portion of the upper end wall projects out from the anterior end 13 of the base 12. A protection band 25 composed of non-marking rubber is secured to the side wall around its periphery. The diameter of the side wall of the skirt 22, including the protection band 25, is slightly smaller than the 20" diameter of the treatment element 26. This size differential enables the outer edge of the treatment element 26 to scrub very close to a wall without being blocked by the skirt 22.

The base 12 is composed of a high strength aluminum alloy and includes the opposing sides, the anterior end 13, and a posterior end 15. The anterior end 13 is arcuate while the posterior end 15 has notched corners. An axle (not shown) is journaled through aligned holes in the opposing sides of the base 12. A pair of wheels 8 are respectively secured to the axle on the opposing sides of the base 12. The wheels 8 permit the rotary floor machine 10 to be transported when the rotary floor machine 10 is not running.

An elongated recess 17 is disposed in the base 12 towards the posterior end 15. The elongated recess 17 is parallel to the posterior end 17 and has opposing end walls and anterior and posterior side walls. The opposing end walls have openings that are aligned with openings in the opposing sides of the base 12 so as to form an interior passage. The base 12 is also provided with a sloping recess 16 that is disposed perpendicular to the elongated recess 17. The sloping recess 16 slopes upward and rearward from the center of the posterior side wall of the elongated recess 17.

Figure 2:
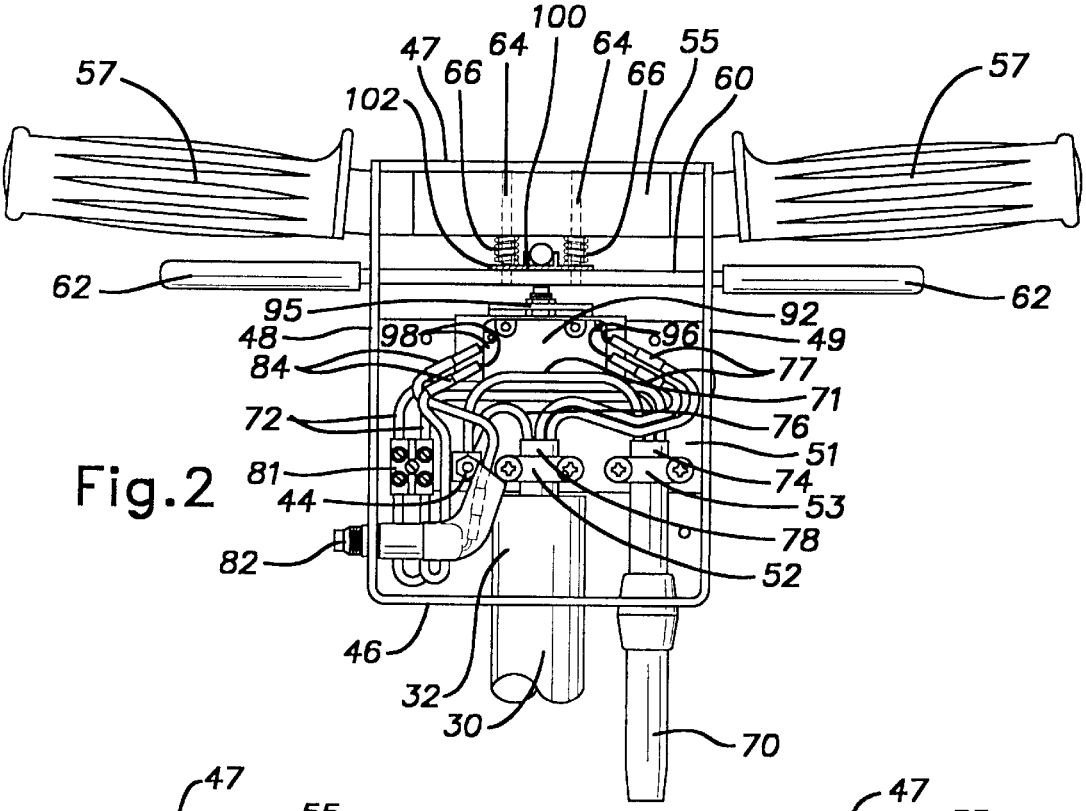
FIG. 2 shows a front schematic view of the interior of a switch box that is mounted on top of a pole handle and contains a lock-out device.
Figure 3:
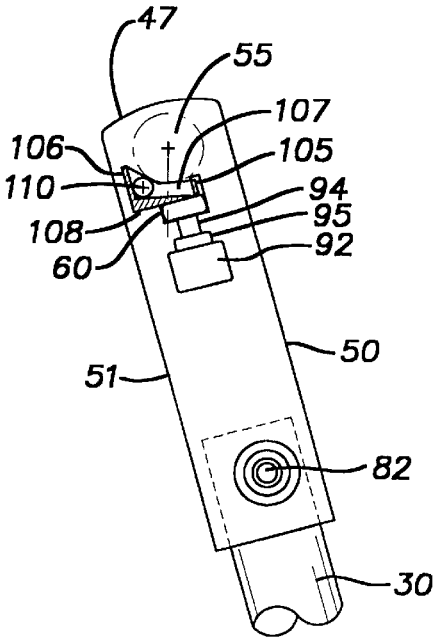
FIG. 3 shows a side schematic view of the lock-out device when the pole handle is in a rear angular position.
Figure 4:
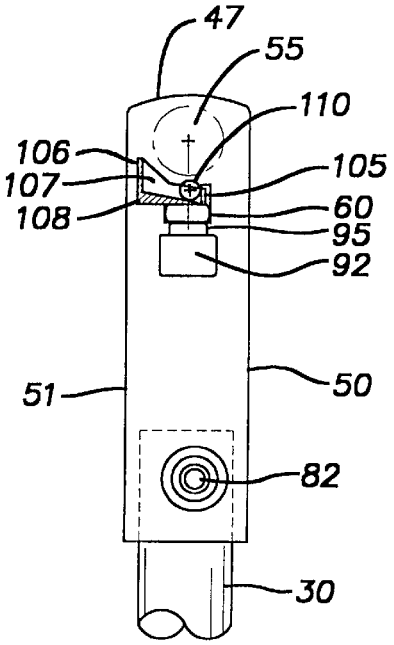
FIG. 4 shows a side schematic view of the lock-out device when the pole handle is in a vertical position.

The pole handle 30 is composed of chrome-plated steel and has a hollow interior, a first end 31, and a second end 32 (shown in FIGS. 2, 3, 4). The first end 31 is secured to a pivot rod 18 journaled through the interior passage, while the second end 32 is connected to the switch box 45. The pivot rod 18 permits the pole handle 30 to pivot between a plurality of positions. The first end 31 of the pole handle 30 is secured to the center of the pivot rod 18 so as to be laterally aligned with the sloping recess 16. In this manner, the pole handle 30 can pivot to a rear angular position wherein the pole handle 30 projects rearward toward the operator. When the rotary floor machine 10 is being stored-away, the pole handle 30 is typically moved to a vertical position wherein the pole handle 30 is perpendicular to the base 12 or is moved to a front angular position wherein the pole handle 30 projects forward.

A handle lock assembly 35 is provided to secure the pole handle 30 in a selected position. The handle lock assembly 35 includes a clamp 36, a cam handle 37 with an elongated head, a hollow spacer (not shown), a lock stud (not shown), a lock nut (not shown), a first mounting strap 41 and a second mounting strap (not shown). The clamp 36 is substantially U-shaped and has a pair of legs with holes passing therethrough that are connected by a bight. The clamp 36 is disposed around the pole handle 30 with its legs projecting rearward. The first mounting strap 41 and the second mounting strap each have upper and lower ends that are bent in opposing directions and have openings passing therethrough. The lower ends of the first mounting strap 41 and the second mounting strap are secured to the base 12 at the notched corners. The upper ends of the first mounting strap 41 and the second mounting strap are respectively disposed against the legs of the clamp 36 such that the openings in the first mounting strap 41 and the second mounting strap are aligned with the holes in the legs. The hollow spacer is disposed between the legs and is aligned with both the openings in the first mounting strap 41 and the second mounting strap and the holes in the legs so as to define a passage therethrough.

The lock stud is disposed within the passage and has first and second ends that respectively project out from the first mounting strap 41 and the second mounting strap. The lock nut is connected to the first end of the lock stud while the elongated head of the cam handle 37 is connected to the second end of the lock stud so as to pivot about an axis. The elongated head has a top edge that makes contact with the first mounting strap 41 when the cam handle 37 is in an upper or unlocked position and has an outer edge that makes contact with the first mounting strap 41 when the cam lever is in a lower or locked position. Since the outer edge is farther away from the axis than the top edge, the head portion pushes the first mounting strap 41 inward and, therefore, compresses the legs together when the cam handle 37 is moved from the unlocked position to the locked position. Thus, the cam handle 37 tightens the clamp 36 and prevents the clamp 36 from sliding along the pole handle 30 when the cam handle 37 is moved to the locked position. Since the clamp 36 is secured to the base 12 by the first mounting strap 41 and the second mounting strap, the handle lock assembly 35 secures the pole handle 30 in a selected position when the cam handle 37 is in the locked-position.

Power is supplied to the electric motor 5 by a power circuit having a supply cord 70, a power cord 75, an overload protection circuit, and a switch mechanism. Both the overload protection circuit and the switch mechanism are enclosed within the switch box 45. The supply cord 70 is long and flexible and is comprised of a supply ground 71 (shown in FIG. 2) and a pair of supply conductors 72 (shown in FIG. 2) enclosed within a supply casing 74 (shown in FIG. 2) having first and second ends. The supply ground 71 and the supply conductors 72 each have a first end and a second end that respectively project out of the first and second ends of the supply casing 74. The supply cord 70 begins inside the switch box 45 where the first ends of the supply ground 71 and the supply conductors 72 are located. The supply cord 70 extends through a sealed opening in a bottom panel 46 of the switch box 45 and then projects outward into the surrounding environment. The supply cord 70 terminates inside a plug assembly 73 having a plurality of contacts that receive the second ends of the supply ground 71 and the supply conductors 72. The plug assembly 73 is adapted for insertion into a household electrical outlet.

The power cord 75 is also flexible and is comprised of a power ground 76 (shown in FIG. 2) and a pair of power conductors 77 (shown in FIG. 2) enclosed within a power casing 78 having upper and lower ends. The power ground 76 and the power conductors 77 each have an upper end and a lower end that respectively project out of the upper and lower ends of the power casing 78 (shown in FIG. 2). The power cord 75 begins inside the motor housing 28 where the lower ends of the power ground 76 and the power conductors 77 are connected to contacts on the electric motor 5. The power cord 75 passes through an aperture in the motor housing 28 and extends into the hollow interior of the pole handle 30 through a hole in the bottom thereof. The power cord 75 then travels up the hollow interior and enters the switch box 45. The power cord 75 terminates inside the switch box 45 where the upper ends of the power ground 76 and the power conductors 77 are located.

Referring now to FIG. 2, there is shown an interior view of the switch box 45. The switch box 45 is mounted on top of the pole handle 30, which is shown in the vertical position. The switch box 45 is composed of steel and encloses the switch mechanism, the overload protection circuit, and the lock-out device 100 embodied in accordance with the present invention. The switch box 45 is substantially rectangular and includes the bottom panel 46, a top panel 47, first and second side panels 48, 49, a front panel 50 (shown in FIGS. 1, 3, 4) and a rear panel 51. The second end 32 of the pole handle 30 extends into the switch box 45 through a circular opening in the bottom panel 46. The pole handle 30 is secured to the switch box 45 around the circular opening by welding or other means.

As described earlier, the power cord 75 extends out of the second end of the pole handle 30 and into the switch box 45. The power cord 75 is secured within the interior of the switch box 45 by a first clamp 52 disposed around the power cord 75 and secured to the rear panel 51 of the switch box 45 with screws. The upper end of the power ground 76 and the upper ends of the power conductors 77 are fitted with connectors and project out from the upper end of the power casing 78. The upper end of the power ground 76 is connected to a ground lug 44 disposed within the switch box 45, while the upper ends of the power conductors 77 are respectively connected to output terminals 96 on the switch mechanism.

Also as described earlier, the supply cord 70 begins inside the switch box 45 and projects out into the outside environment through the sealed opening in the bottom panel 46. The supply cord 70 is secured within the interior of the switch box 45 by a second clamp 53 disposed around the supply cord 70 and secured to the rear panel 51 of the switch box 45 with screws. The first end of the supply ground 71 and the first ends of the supply conductors 72 are fitted with connectors and project out from the first end of the supply casing 74. The first end of the supply ground 71 is connected to the ground lug 44, while the first ends of the supply conductors 72 are connected to overload terminals 81 on the overload protection circuit.

The overload protection circuit operates to prevent an overload of the electric motor 5. The overload protection circuit includes a circuit breaker (not shown), a reset pushbutton 82, and a pair of intermediate conductors 84 having first and second ends. The reset pushbutton 82 projects through the first side panel 48 of the switch box 45 and is operable to reset the circuit breaker. The circuit breaker has an input side that is electrically connected to the overload terminals 81 and an output side that is electrically connected to the first ends of the intermediate conductors 84. The second ends of the intermediate conductors 84 are fitted with connectors and are connected to input terminals 98 on the switch mechanism. Thus, the overload protection circuit electrically connects the supply conductors 72 to the switch mechanism. If the electric motor 5 is being provided with electric power through the switch mechanism and the electric motor 5 draws electric current in excess of 20 amps, the circuit breaker will trip and interrupt the flow of electric power to the switch mechanism and, thus, the electric motor 5. Depressing the reset pushbutton 82 resets the circuit breaker and reestablishes the flow of electric power to the switch mechanism.

The switch mechanism is centrally disposed within the switch box 45 and has a pair of contacts (not shown) enclosed within a switch housing 92. The contacts each have an input end and an output end. The input ends of the contacts are connected to the input terminals 98, while the output ends are connected to the output terminals 96. The contacts are closed by a switch pushbutton 94 (shown in FIG. 3) that projects upward from the switch housing 92. The switch pushbutton 94 is mounted within a pushbutton housing 95 and is movable between a depressed position and an extended position. In the extended position, the switch pushbutton 94 closes the contacts. In the depressed position, the switch pushbutton 94 opens the contacts. The switch pushbutton 94 is spring biased towards the extended position. Accordingly, the switch mechanism is a normally closed, double pole, single-throw momentary switch that controls the electrical connection of the supply conductors 72 to the power conductors 77. If the switch pushbutton 94 is in the extended position, the switch mechanism connects the supply conductors 72 to the power conductors 77 and provides the electric motor 5 with electric power, provided, of course, the supply cord 70 is connected to the household electrical outlet and the circuit breaker is not tripped. In order to simplify the description of the operation of the switch mechanism in the paragraphs to follow, it will be assumed, unless otherwise noted, that the supply cord 70 is connected to the household electrical outlet and that the circuit breaker is not tripped.

In addition to enclosing the overload protection circuit and the switch mechanism, the switch box 45 encloses portions of the handlebar 55 and the trigger bar 60. The first and second side panels 48, 49 of the switch box 45 each contain an upper opening and a lower opening. The upper and lower openings in the first side panel 48 are aligned with the upper and lower openings in the second side panel 49 so as to form upper and lower passages through the switch box 45. The handlebar 55 is secured within the upper passage, while the trigger bar 60 is disposed within the lower passage. Accordingly, the handlebar 55 and the trigger bar 60 are parallel to each other and are both perpendicular to the pole handle 30. The handlebar 55 and the trigger bar 60 each have first and second ends that respectively project outward from the first and second side panels 48, 49. The first and second ends of the handlebar 55 are fitted with ribbed grips 57, while the first and second ends of the trigger bar 60 are fitted with rubberized grips 62. The handlebar 55 is substantially larger in cross-sectional area than the trigger bar 60 and projects outward farther from the first and second side panels 48, 49 than the trigger bar 60. In addition, the handlebar 55 is cylindrical, while the trigger bar 60 is oblong and has upper and lower surfaces that are substantially flat. Both the handlebar 55 and the trigger bar 60 are composed of steel.

Inside the switch box 45, the trigger bar 60 is disposed above the switch housing 92. A pair of slide passages extend through the trigger bar 60 and are disposed on opposing sides of the switch pushbutton 94. The lock-out device 100 is secured to the upper surface of the trigger bar 60 and has a pair of openings aligned with the slide passages. The trigger bar 60 is movably attached to the handlebar 55 by a pair of mounting rods 64 having top portions secured within a pair of bores passing through the handlebar 55. The mounting rods 64 project downward from the handlebar 55 and extend through the openings in the lock-out device 100 and into the slide passages in the trigger bar 60. The mounting rods 64 extend through the slide passages and terminate at lower ends located below the bottom surface of the trigger bar 60. This arrangement permits the trigger bar 60 to slide up and down along the mounting rods 64. A pair of bias springs 66 are respectively disposed around the mounting rods 64 between the handlebar 55 and the trigger bar 60. The bias springs 66 urge the trigger bar 60 downward to a distal position. The downward travel of the trigger bar 60 is limited to the distal position by the pushbutton housing 95 and by enlarged flanges on the lower ends of the mounting rods 64 that prevent the lower ends from travelling through the passages in the trigger bar 60. In the distal position, the trigger bar 60 abuts the pushbutton housing 95 with the switch pushbutton 94 being retained in the depressed position therebetween. As described earlier, when the switch pushbutton 94 is in the depressed position, the contacts in the switch mechanism are open and the electric motor 5 is cut-off from electrical power.

Referring now to FIG. 4 as well as to FIG. 2, the lock-out device 100 is shown with the pole handle 30 being in the vertical position. The lock-out device 100 includes a base 102, a channel track and a spherical element 110, all of which are composed of steel. The base 102 is substantially flat and has front and rear edges and first and second side edges. A front portion of the base 102 is secured to the upper surface of the trigger bar 60 by welding or other means and contains the openings through which the mounting rods 64 project. A rear portion of the base 102 is not secured to the trigger bar 60 and projects rearward from the trigger bar 60.

The channel track is laterally positioned between the mounting rods and is vertically positioned between the trigger bar 60 and the handlebar 55. The channel track includes a front wall 105, a rear wall 106, opposing side walls 107 and a bottom wall 108. The rear wall 106 projects upward from the rear edge of the base 102. The rear wall 106 is spaced to the rear of the handlebar 55 and extends upward beyond the lower periphery of the handlebar 55. The front wall 105 is substantially shorter than the rear wall 106. The front wall 105 projects upward from the front edge of the base 102 and terminates at a top edge that is spaced below the lower periphery of the handlebar 55. The bottom wall 108 is joined to the base 102 and has a narrow width relative to the base 102. The bottom wall 108 slopes downward from the rear wall 106 to the front wall 105. The opposing side walls 107 extend from the rear wall 106 to the front wall 105. The opposing side walls 107 slope downward from the rear wall 106 at an angle approaching 45°. At a point approximately half-way between the front and rear walls 105, 106, the opposing side walls 107 substantially level out and extend to the front wall 105 at a slight downward angle.

With the channel track positioned between the handlebar 55 and the trigger bar 60, upward movement of the trigger bar 60 toward the handlebar 55 is limited by interfering portions of the opposing side walls 107 that are located between the handlebar 55 and the trigger bar 60. When the interfering portions of the opposing side walls 107 abut the lower periphery of the handlebar 55 as shown in FIG. 3, the trigger bar 60 is in a proximate position to the handlebar 55 and is precluded from moving any closer to the handlebar 55. In the proximate position, the trigger bar 60 is spaced far enough above the pushbutton housing 95 to permit the switch pushbutton 94 to move upward to the extended position. As described earlier, when the switch pushbutton 94 is in the extended position, the contacts in the switch mechanism are closed and the electric motor 5 is provided with electrical power.

As can be appreciated from the foregoing description, the relationship between the trigger bar 60 and the switch mechanism controls the operation of the rotary floor machine 10. When an operator moves the trigger bar 60 upward to the proximate position against the action of the bias springs 66 as shown in FIG. 3, the switch pushbutton 94 moves to the extended position and thereby provides the electric motor 5 with electric power. When the operator releases the trigger bar 60, the bias springs 66 move the trigger bar 60 downward to the distal position as shown in FIGS. 2, 4, causing the trigger bar 60 to move the switch pushbutton 94 to the depressed position and thereby cut-off electric power to the electric motor 5.

The spherical element 110 of the lock-out device prevents the movement of the trigger bar 60 from the distal position to the proximate position when the pole handle 30 is in the vertical position. The spherical element 110 is solid steel and has a diameter that is larger than the height of the interfering portions of the opposing side walls 107. The spherical element 110 of the lock-out device 100 is positioned within the channel track and is movable therein between the front and rear walls 105, 106 in response to changes in the spatial orientation of the bottom wall 108. When the pole handle 30 is in a rear angular position as shown in FIG. 3, the bottom wall 108 has a rearward slope, i.e., the bottom wall 108 slopes downward from the front to the rear of the rotary floor machine 10. As a result, the spherical element 110 is positioned against the rear wall 106 of the channel track. In this position, the spherical element 110 is not located between the handlebar 55 and the trigger bar 60. Thus, the spherical element 110 does not prevent the trigger bar 60 from reaching the proximate position when the trigger bar 60 is moved upward. Accordingly, the operator can move the trigger bar 60 to the proximate position and, thus, can turn the rotary floor machine 10 on when the pole handle 30 is in a rear angular position.

When the pole handle 30 is pivoted forward to a vertical position or a forward angular position, the bottom wall 108 first becomes horizontal and then slopes downward from the rear to the front of the rotary floor machine 10, i.e., has a forward slope. In response to the change in orientation of the bottom wall 108 from having a rearward slope to a forward slope, the spherical element 110 moves away from the rear wall 106 and rolls down the channel track to the front wall 105. With reference now to FIG. 4, the pole handle 30 is shown in the vertical position. As a result of the forward slope of the bottom wall 108, the spherical element 110 is positioned against the front wall 105 of the channel track. In this position, the spherical element 110 is located between the handlebar 55 and the trigger bar 60 and projects above the interfering portions of the opposing side walls 107. Thus, when the trigger bar 60 is moved upward, the spherical element 110 contacts the handlebar 55 first, thereby preventing the interfering portions of the opposing side walls 107 from contacting the handlebar 55. As a result, the trigger bar 60 is prevented from reaching the proximate position. Accordingly, the operator cannot move the trigger bar 60 to the proximate position and, thus, cannot turn the rotary floor machine 10 on when the pole handle 30 is in the vertical position or in a forward angular position.

Before the operator can move the trigger bar 60 to the proximate position, the operator must cause the spherical element 110 to move to the rear wall 106. The operator accomplishes this by pivoting the pole handle 30 rearward so as to change the orientation of the bottom wall 108 from having a forward slope to having a rearward slope. The bottom wall 108, however, does not immediately attain a rearward slope when the pole handle 30 is pivoted rearward from the vertical position. The bottom wall 108 retains a forward slope for a short while, then becomes horizontal and then obtains a rearward slope. Accordingly, the operator cannot turn the rotary floor machine 10 on when the pole handle 30 is in a rear angular position approaching the vertical position.

It should be appreciated from the foregoing description of the rotary floor machine 10 that the lock-out device 100 does not function as a trigger mechanism like other prior art lock-out devices. In the rotary floor machine 10 of the present invention, the trigger mechanism is comprised of the trigger bar 60 and the switch mechanism. The function of the lock-out device 100 is to prevent this trigger mechanism from being activated. Thus, in order to start the rotary floor machine 10 of the present invention, two separate actions must be performed: the pole handle 30 must first be moved to a rear angular position that does not approach the vertical position and then the trigger bar 60 must be moved to the proximate position.

Although the preferred embodiments of this invention have been shown and described, it should be understood that various modifications and rearrangements of the parts may be resorted to without departing from the scope of the invention as disclosed and claimed herein. For example, the base 102 and the channel track can be composed of another rigid material such as rigid plastic, while the spherical element 110 can be composed of another dense and rigid material like iron. In addition, the spherical element 110 can be replaced with a cylindrical element and the channel track can be replaced with a structure having sloping slots for accommodating the cylindrical element.

What is claimed is:

1. A rotary floor machine comprising:

a base having a front and a rear;

a pole handle pivotally secured to the base and movable between first and second positions;

a pole structure secured to the pole handle;

a handlebar secured to the pole structure so as to be substantially perpendicular to the pole handle;

a trigger bar for controlling the starting and stopping of the rotary floor machine, said trigger bar being mounted to the handlebar so as to be movable between proximate and distal positions relative to the handlebar, said trigger bar starting the rotary floor machine when in the proximate position and stopping the rotary floor machine when in the distal position;

a lock-out device having an element movable between a blocking position and an un-blocking position in response to movement of the pole handle between the first and second positions, said element blocking the movement of the trigger bar from the distal position to the proximate position when the element is in the blocking position, said element not blocking the movement of the trigger bar from the distal position to the proximate position when the element is in the un-blocking position, said element being in the blocking position and thereby preventing the starting of the rotary floor machine when the pole handle is in the first position, said element being in the un-blocking position and thereby permitting the starting of the rotary floor machine when the pole handle is in the second position.

2. The rotary floor machine of claim 1 wherein the second position is a rear angular position.

3. The rotary floor machine of claim 2 wherein the first position is a vertical position.

4. The rotary floor machine of claim 2 wherein the first position is a front angular position.

5. The rotary floor machine of claim 1 wherein the element is spherical.

6. The rotary floor machine of claim 5 wherein the lockout device further comprises a track having a bottom wall upon which the element is disposed, said bottom wall being secured at the top of the trigger bar and having a forward slope when the pole handle is in the first position and a rearward slope when the pole handle is in the second position, said element moving from the un-blocking to the blocking position in response to a change in orientation of the bottom wall from having a rearward slope to having a forward slope.

7. A rotary floor machine for treating a floor, said rotary floor machine comprising:

an electric motor having a shaft that rotates when the electric motor is provided with electric power;

a base upon which the electric motor is vertically mounted, said base having a front, a rear and an opening through which the shaft projects;

a treatment element for contacting the floor, said treatment element being located beneath the base and being secured to the shaft for rotation therewith;

a pole handle pivotally secured to the base and movable between a first position and a second position;

an enclosure secured to the pole handle and having opposing sides;

a handlebar passing through the enclosure and extending outward from the opposing sides;

a trigger bar passing through the enclosure and extending outward from the opposing sides, said trigger bar being movable relative to the handlebar between proximate and distal positions and being biased toward the distal position;

means for controlling connection of electric power to the electric motor in response to movement of the trigger bar between the proximate and distal positions, said controlling means connecting electric power to the electric motor when the trigger bar is in the proximate position and disconnecting electric power to the electric motor when the trigger bar is in the distal position; and a lock-out device having an element movable between a blocking position and an un-blocking position in response to movement of the pole handle between the first and second positions, said element blocking the movement of the trigger bar from the distal position to the proximate position when the element is in the blocking position, said element not blocking the movement of the trigger bar from the distal position to the proximate position when the element is in the un-blocking position, said element being in the blocking position and thereby preventing the connection of electric power to the electric motor when the pole handle is in the first position, said element being in the un-blocking position and thereby permitting the connection of electric power to the electric motor when the pole handle is in the second position.

8. The rotary floor machine of claim 7 wherein the second position is a rear angular position.

9. The rotary floor machine of claim 8 wherein the first position is a vertical position.

10. The rotary floor machine of claim 7 wherein the controlling means is comprised of a pushbutton and a normally closed, double pole, single-throw momentary switch that is closed by the pushbutton.

11. The rotary floor machine of claim 7 wherein the element is spherical.

12. The rotary floor machine of claim 11 wherein the trigger bar is located below and is substantially parallel with the handlebar.

13. The rotary floor machine of claim 12 wherein the lock-out device further comprises a track secured to the top of the trigger bar, said track comprising:

a front wall;

a rear wall higher than the front wall;

opposing side walls that are angled and generally slope downward from the rear wall to the front wall; and a bottom wall having a forward slope when the pole handle is in the first position and having a rearward slope when the pole handle is in the second position.

14. The rotary floor machine of claim 13 wherein the front wall is located between the trigger bar and the handlebar and wherein the rear wall is spaced to the rear of both the handlebar and the trigger bar.

15. The rotary floor machine of claim 14 wherein the element is disposed within the track and is movable between the front and rear walls in response to changes in orientation of the bottom wall, said element abutting the front wall when the bottom wall has a forward slope and abutting the rear wall when the bottom wall has a rearward slope, said element being in the blocking position when the element abuts the front wall and being in the unblocking position when the element abuts the rear wall.

16. The rotary floor machine of claim 15 wherein the opposing side walls of the track abut the handlebar when the trigger bar is in the proximate position.

17. The rotary floor machine of claim 16 wherein the element is located between the handlebar and the trigger bar and projects above the opposing side walls when the element is in the blocking position, thereby preventing the trigger bar from being moved to the proximate position; and wherein the element is not located between the handlebar and the trigger bar when the element is in the un-blocking position, thereby permitting the trigger bar to be moved to the proximate position.

18. A rotary floor machine for treating a floor, said rotary floor machine comprising:

an electric motor having a shaft that rotates when the electric motor is provided with electric power;

a base upon which the electric motor is vertically mounted, said base having a front, a rear and an opening through which the shaft projects;

a treatment element for contacting the floor, said treatment element being located beneath the base and being secured to the shaft for rotation therewith;

a pole handle pivotally secured to the base so as to be movable between a vertical position and a rear angular position;

an enclosure secured to the pole handle and having opposing sides;

a handlebar passing through the enclosure and extending outward from the opposing sides;

a switch mechanism for controlling connection of electric power to the electric motor, said switch mechanism being located inside the enclosure and having a member that is movable in opposing directions between first and second positions and is biased toward the first position, said switch mechanism connecting electric power to the electric motor when the member is in the first position and disconnecting electric power to the electric motor when the member is in the second position;

a trigger bar passing through the enclosure adjacent to the switch mechanism and extending outward from the opposing sides, said trigger bar being movable relative to the handlebar between proximate and distal positions and being biased toward the distal position, said trigger bar retaining the member of the switch mechanism in the second position when the trigger bar is in the distal position and permitting the member to move to the first position when the trigger bar is moved to the proximate position; and a lock-out device having an element movable between a blocking position and an un-blocking position in response to movement of the pole handle between the vertical position and the rear angular position, said element blocking the movement of the trigger bar from the distal position to the proximate position when the element is in the blocking position, said element not blocking the movement of the trigger bar from the distal position to the proximate position when the element is in the un-blocking position, said element being in the blocking position and thereby preventing the connection of electric power to the electric motor when the pole handle is in the vertical position, said element being in the un-blocking position and thereby permitting the connection of electric power to the electric motor when the pole handle is in the rear angular position.

19. The rotary floor machine of claim 18 wherein the lock-out device further comprises a track having a bottom wall upon which the element is disposed, said bottom wall being secured to the top of the trigger bar and having a forward slope when the pole handle is in the vertical position and a rearward slope when the pole handle is in the rear angular position, said element moving from the un-blocking to the blocking position in response to a change in orientation of the bottom wall from having a rearward slope to having a forward slope.

20. The rotary floor machine of claim 18 further comprising means for releasably securing the pole handle in the vertical position and the rear angular position.

21. The rotary floor machine of claim 18 wherein the member is comprised of a pushbutton and wherein the first position is an extended position and the second position is a depressed position.

22. The rotary floor machine of claim 21 wherein the trigger bar depresses the member to the second position when the trigger bar is allowed to move from the proximate position to the distal position.

* * * * *

UNITED STATES PATENT AND TRADEMARK OFFICE

CERTIFICATE OF CORRECTION

PATENT NO. : 5,768,735

DATED : June 23, 1998

INVENTOR(S) : Wiese et al.

It is certified that error appears in the above-identified patent and that said Letters Patent is hereby corrected as shown below:

On the title page, item [73], delete "Whtie" and insert --White--.

Column 5, Line 68, delete "locked-position" and insert --locked position--.

Signed and Sealed this

Thirteenth Day of October 1998

*Attest:*

*Attesting Officer*

BRUCE LEHMAN

*Commissioner of Patents and Trademarks*